US007322483B2

(12) United States Patent
Richardson

(10) Patent No.: US 7,322,483 B2
(45) Date of Patent: Jan. 29, 2008

(54) CANTILEVER SHELVING FOR UTILITY SHED

(75) Inventor: Jed C. Richardson, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 131 days.

(21) Appl. No.: 11/218,066

(22) Filed: Aug. 31, 2005

(65) Prior Publication Data

US 2007/0045210 A1 Mar. 1, 2007

(51) Int. Cl.
*A47F 5/08* (2006.01)

(52) U.S. Cl. ..... 211/90.02; 211/103; 211/187

(58) Field of Classification Search ..... 211/90.02, 211/90.01, 87.01, 103, 106.01, 193, 187, 211/190, 208; 248/235, 247, 248, 250
See application file for complete search history.

(56) References Cited

U.S. PATENT DOCUMENTS 2,429,586 A * 10/1947 Rompre ..... 248/248
3,054,511 A * 9/1962 Erismann ..... 211/208
4,809,940 A * 3/1989 Trestyn ..... 248/220.22
5,588,541 A 12/1996 Goetz
5,709,158 A 1/1998 Wareheim
6,070,841 A * 6/2000 Robinson ..... 248/220.43
6,178,896 B1 1/2001 Houk, Jr. et al.
6,892,993 B2 * 5/2005 Palmer ..... 248/346.02
6,935,518 B2 * 8/2005 Winig et al. ..... 211/90.02
2002/0179797 A1 * 12/2002 Cunha ..... 248/343
2003/0197102 A1 * 10/2003 Lin ..... 248/220.43
2006/0261025 A1 * 11/2006 Heyderman et al. ..... 211/187

* cited by examiner

*Primary Examiner*—Jennifer E. Novosad
(74) *Attorney, Agent, or Firm*—McHale & Slavin, P.A.

(57) ABSTRACT

A cantilevered shelving system is provided for manual assembly along the wall panels of a molded utility shed. Several shelves are provided that are removably secured to brackets that removably fasten into reinforcing strips in the wall panels. Each shelf is supported by at least two triangular brackets near the opposite ends. The brackets have upper and lower fasteners on a vertical leg that pivotably connect to the shed through apertures in the reinforcing strips.

8 Claims, 4 Drawing Sheets

CANTILEVER SHELVING FOR UTILITY SHED

RELATED APPLICATIONS

This application is related to U.S. patent application Ser. No. 11/216,929, filed Aug. 30, 2005 entitled, Plastic Expandable Utility Shed and U.S. patent application Ser. No. 11/217,253, filed Aug. 31, 2005 entitled Stacking Shelving System for a Utility Shed.

BACKGROUND OF THE INVENTION

This invention relates generally to a large enclosure constructed of plastic structural panels. More specifically, the present invention relates to a modular construction system utilizing shelves having integrated connectors to cooperate with integrated connectors in the structural panels for stability and support.

Utility sheds are a necessity for lawn and garden care, as well as general all-around home storage space. Typically, items such as garden tractors, snow blowers, tillers, ATVs, motorcycles and the like consume a great deal of the garage floor space available, forcing the homeowner to park his automobile outside.

The large items, such as mentioned above, require accessories and supplies that must also be stored, as well as other small tools. To avoid using more floor space for these supplies, a system of shelving is usually constructed as free standing units or attached to the walls of the sheds. Free standing units are unstable, particularly, when carrying a top-heavy load. And in the modular plastic sheds, now available, it is difficult to attach shelves to the plastic panels without damaging the integrity of the panels.

DESCRIPTION OF THE PRIOR ART

Modular shelving systems are well known as illustrated by U.S. Pat. No. 6,178,896 to Houk, Jr., U.S. Pat. No. 5,709,158 to Wareheim and U.S. Pat. No. 5,588,541 to Goetz. These are stand-alone modular units with multiple horizontal shelves supported by sectional legs or, in the case of the Goetz patent, a back panel.

SUMMARY OF THE INVENTION

Accordingly, it is a primary objective of the instant invention to provide a cantilevered shelving system for cooperating with structural elements in a plastic utility shed for stability and support.

It is another objective of the instant invention to provide a modular shelving system with flexibility in assembly to support different size and different weight articles.

It is a still further objective of the instant invention to provide manual assembly of the shelving system.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
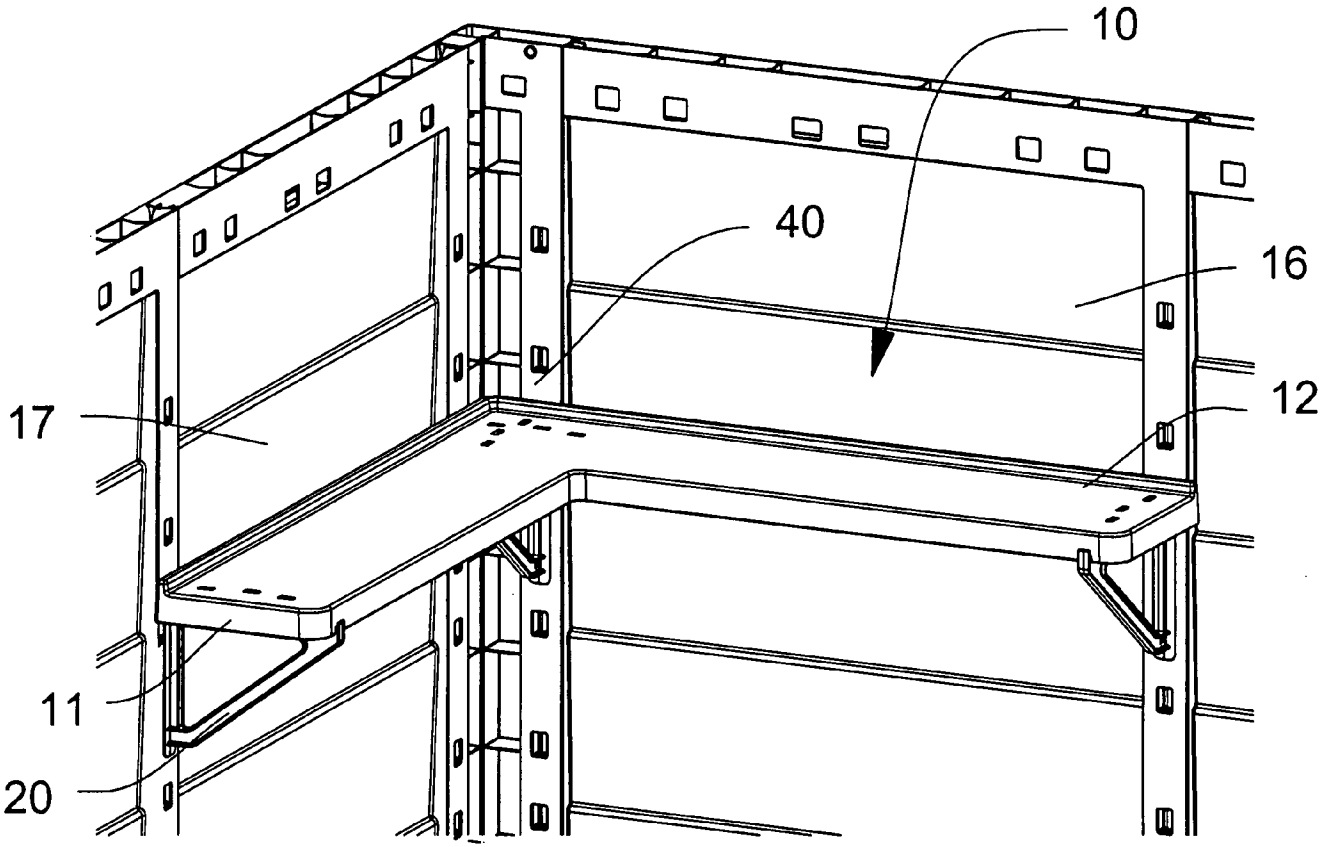
FIG. 1 is a perspective of the interior of a utility shed with a cantilever shelf.

The modular cantilever shelving system 10 is designed to cooperate with the wall panels of a molded plastic utility shed to provide storage space. The shelving system may be manually installed without tools and is removable. As shown in the drawings, the shelving system 10 has a molded shelf 11 with a storage surface 12 supported by an integral frame of stringers 13 and bulkheads 14. The ends of the stringers and bulkheads are joined together by a peripheral flange 15 depending from the storage surface 12. A corner shelf is shown in FIG. 1 molded in a right angle to fit in the interior corner formed by shed walls 16 and 17. Of course, straight shelf modular units are also included to extend between reinforcing strips that are spaced along each side wall. The individual shelves are of a length to span the distance between reinforcing strips to provide for a bracket 20 at each end of the shelves. Some straight shelves may be longer, e.g. in multiples of the distance between reinforcing strips. In such instances intermediate brackets 20 may be installed on each reinforcing strip spanned by the shelf.

Near each end of the shelves there is a depending hook 18 which snaps over the horizontal support of a bracket. The hook must be deflected to clear the bracket when it is assembled. This results in a spring bias on the hook and bracket to secure the shelf.

Figure 2:
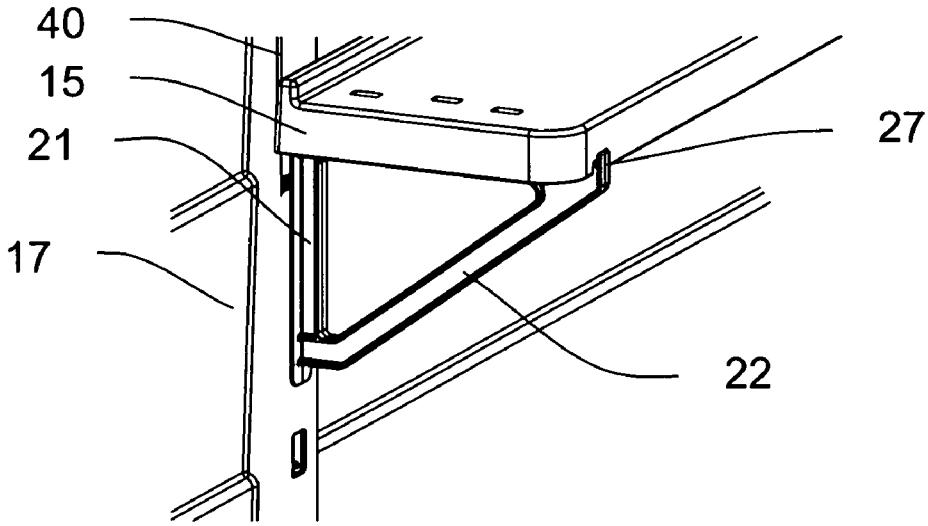
FIG. 2 is a perspective of a cantilever bracket.

The bracket 20, shown in the drawings, may be metal or plastic or other material of sufficient strength to support the shelving and a useful load. As shown in FIGS. 1 and 2, the bracket has a vertical leg and an integral cantilever leg 22. The vertical leg has a fastener 23 at the top and another fastener 24 at the bottom to secure the bracket in the reinforcing strips apertures 25 and 26 to maintain alignment with the strip and carry the load of the stocked shelf. The cantilever leg 22 extends upwardly from the bottom of the vertical leg at approximately 45 degrees to intersect the outer edge of the shelf 11. The upper end of the cantilever leg terminates with an upstanding flange 27 which stabilizes the free end of the bracket and supports the outer end of the shelf. The shelf 11 serves to separate the upper ends of the vertical leg and the cantilever leg and distribute the load.

Figure 3:
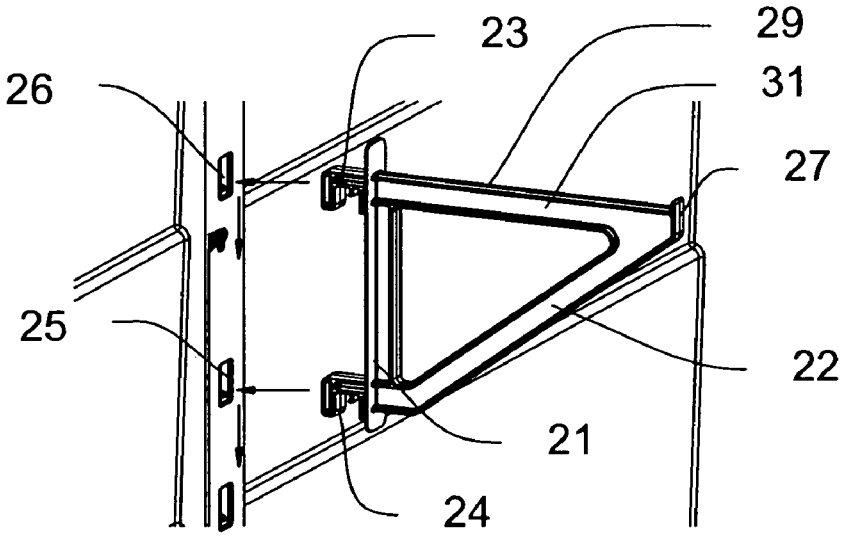
FIG. 3 is and exploded view of a cantilever bracket and reinforcing strip.
Figure 4:
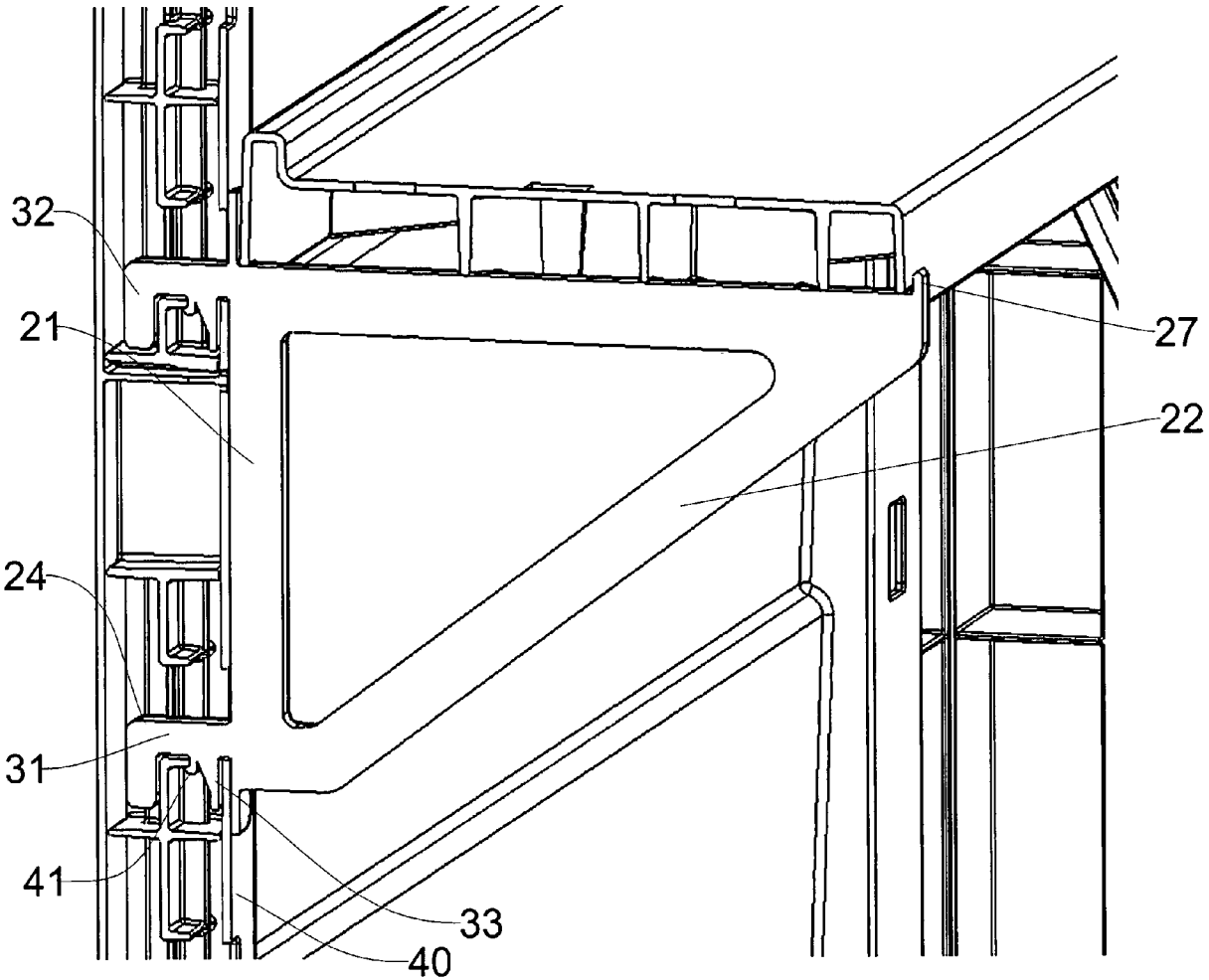
FIG. 4 is a partial cross section of a reinforcing strip with a bracket in place.
Figure 5:
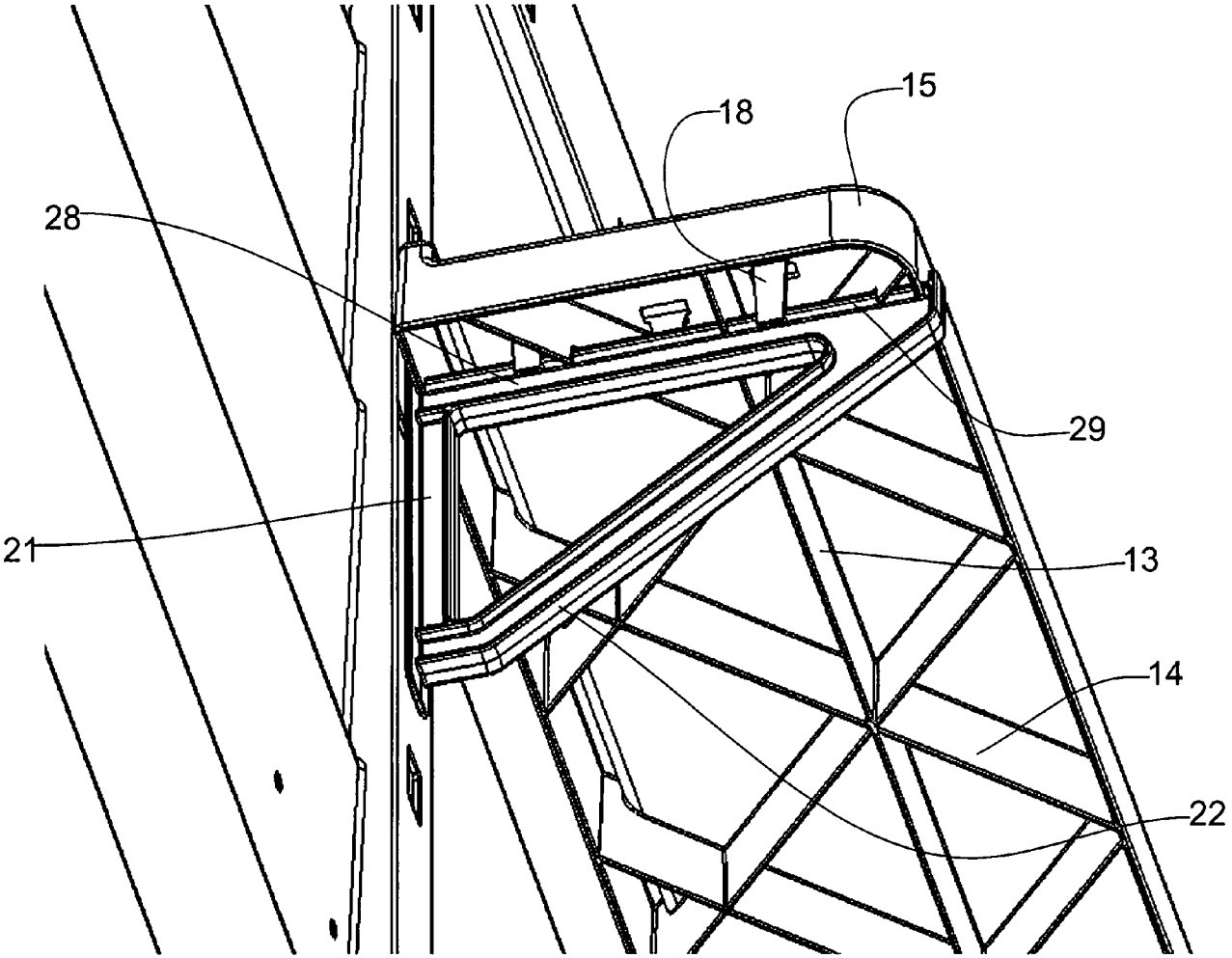
FIG. 5 is a perspective of the bottom of a shelf and a cantilever bracket.

FIGS. 3-5, the bracket 20 has an integral horizontal leg 28 which serves to rigidify the structure in triangular form. The bracket 20 is shaped as an I-beam with a planar surface 29 and 30 at each end of an internal web 31. As mentioned above, the hook 18 is deflected over the planar surface at assembly to provide a spring biased contact between shelf and bracket. The hooks maintain the position of the shelves laterally along the direction of the shed walls and the upstanding flanges maintain the shelves against the shed walls.

The fasteners 23 and 24 of the brackets 20, shown in FIGS. 3 and 4, cooperate with the structure of the shed to form a secure but removable connection between the reinforcing strip and the shelving system. Each fastener has a shaft 31 extending from the vertical leg parallel to the horizontal leg and separated by the distance equal to the vertical distance between apertures in the strips. Each fastener ends in a foot 32 extending parallel to the vertical leg. A locking bar 33 extends from the shaft 31 between the foot 32 and the vertical leg. The locking bar is wedge shaped with the thicker portion joining the shaft 31.

The reinforcing strips 40 are an integral part of the molded shed and are necessary for the structural integrity of the shed. The strips have an additional function of providing the structural strength to support cantilevered shelving. The strips, as shown in FIG. 4, have an internal webbing with planar outer walls. Within the strips are spacers 41 for strength and uniformity of shape.

In assembly of the shelving, the fasteners are inserted through the apertures with the locking bars oriented toward the floor. The brackets 20 are moved downwardly in such a manner that a spacer is located between the locking bar and the foot of a fastener. As the bracket moves downwardly, the wedge shaped locking bar and foot forms a friction fit with the spacer. The shelves can then be snapped in place on adjacent brackets. Since the modules are interchangeable, the units can be mixed and matched to form shelves of different sizes and shapes.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A cantilevered shelving system for installation in a utility shed having structural panels with spaced apertures oriented in horizontal rows and vertical columns comprising at least one shelf having a supporting surface, said shelf including a first end and a second end, a first bracket connected to said shelf and spaced from said first end and a second bracket connected to said shelf and spaced from said second end, each said first bracket and said second bracket having a vertical leg, said shelf contacting an upper end of each said vertical leg, a cantilevered leg connected at one end to a lower end of each said vertical leg, each said cantilevered leg contacting said shelf at an other end, each said vertical leg having an upper fastener and a lower fastener, said upper and lower fasteners each being constructed and arranged to removably engage adjacent apertures in said panels, a horizontal leg, said horizontal leg connecting said upper end of said vertical leg and said other end of said cantilevered leg, said horizontal leg supporting said shelf, a hook attached to and depending from an underside of said supporting surface, said hook engaging said horizontal leg and joining said shelf to each said first and second bracket.

2. A cantilevered shelving system of claim 1 wherein said supporting surface has an integral frame of stringers and bulkheads, ends of said stringers and bulkheads are attached to a peripheral flange depending from said supporting surface.

3. A cantilevered shelving system of claim 1 said other end of said cantilevered leg has a flange extending upwardly, said flange engaging a peripheral flange depending from said supporting surface and securing said shelf on said bracket.

4. A cantilevered shelving system of claim 1 wherein said other end of said cantilevered leg has a flange extending upwardly, said flange securing said shelf on each said first and second bracket.

5. A cantilevered shelving system of claim 4 wherein said upper and lower fasteners each have a shaft connected to said vertical leg and extending outwardly therefrom, said shaft terminating in a foot parallel to said vertical leg, said foot adapted to contact a spacer in said panel.

6. A cantilevered shelving system of claim 1 wherein said upper and lower fasteners each have a shaft connected to said vertical leg and extending outwardly therefrom, said shaft terminating in a foot parallel to said vertical leg, said foot adapted to contact a spacer in said panel.

7. A cantilevered shelving system for a molded utility shed having reinforcing strips in wall panels and apertures formed in said strips, said shelving system comprising a kit having a plurality of shelves, said plurality of shelves being of different lengths, said plurality of shelves having resilient hooks located near the ends of said shelves for securing said shelves in place and a plurality of brackets, each of said brackets having a vertical leg, a horizontal leg and a cantilevered leg joining said vertical leg and said horizontal leg in a triangular shape, said vertical leg having an upper fastener and a lower fastener spaced apart a distance commensurate with the distance between said apertures, an upstanding flange on said cantilevered leg for securing said brackets to said shelves, said hooks being attached to and depending from an underside of said shelves, said hook engaging said horizontal leg and joining said shelves to said brackets, said plurality of brackets constructed and arranged to be mounted in said apertures and said plurality of shelves being constructed and arranged to be secured to said brackets to form different sized shelves inside a utility shed.

8. A cantilevered shelving system for a molded utility shed having reinforcing strips in wall panels and apertures formed in said strips of claim 7 wherein each of said upper fasteners and each of said lower fasteners has a shaft connected at one end with said vertical leg and parallel to said horizontal leg, a foot extending normal to said shaft at an other end, a locking bar parallel to said foot connected to said shaft intermediate said foot and said horizontal leg, said foot and locking bar being constructed and arranged to secure said bracket in said apertures.

* * * * *